US006041947A

United States Patent [19]

Heneveld

[11] Patent Number: 6,041,947

[45] Date of Patent: Mar. 28, 2000

[54] STORAGE RACK FOR ELONGATED ITEMS

[76] Inventor: William R. Heneveld, 431 Adaway Dr., SE., Grand Rapids, Mich. 49546

[21] Appl. No.: 09/067,285

[22] Filed: Apr. 27, 1998

[51] Int. Cl.[7] ..... A47F 7/00

[52] U.S. Cl. ..... 211/70.6; 211/70.1

[58] Field of Search ..... 211/70.6, 60.1, 211/65, 66, 70.1, 87.01; 248/220.4, 220.3

[56] References Cited

U.S. PATENT DOCUMENTS

| | | | |
|---|---|---|---|
| D. 65,357 | 7/1924 | Strnad | 211/66 X |
| D. 67,989 | 8/1925 | Balmer . | |
| D. 75,828 | 7/1928 | Canfield | 211/60.1 X |
| D. 180,106 | 4/1957 | Seifert | 211/60.1 X |
| D. 312,017 | 11/1990 | Gould | D6/553 |
| 374,794 | 12/1887 | Kilmer | 211/65 |
| 453,969 | 6/1891 | Flack | 211/65 X |
| 553,445 | 1/1896 | Zimmerlin . | |
| 659,195 | 10/1900 | Best . | |
| 766,964 | 8/1904 | Danhour | 211/65 |
| 776,764 | 12/1904 | Squire . | |
| 838,473 | 12/1906 | Speiser | 211/65 |
| 900,014 | 9/1908 | Hennermann . | |
| 1,061,431 | 5/1913 | West | 211/60.1 X |
| 1,121,513 | 12/1914 | Lench . | |
| 1,188,791 | 6/1916 | Knechtel | 211/70.6 |
| 1,234,615 | 7/1917 | Bourdeau . | |
| 1,304,427 | 5/1919 | Wheeler . | |
| 1,559,842 | 11/1925 | Bollinger . | |
| 1,706,683 | 3/1929 | Victorsohn | 211/60.1 X |
| 1,987,159 | 1/1935 | Rasmussen | 211/60.1 X |
| 2,468,190 | 4/1949 | Friedheim | 211/70.6 X |
| 2,587,226 | 2/1952 | Rodman | 211/60 |
| 2,815,863 | 12/1957 | Larson | 211/60 |
| 2,833,419 | 5/1958 | Trumpy | 211/70.6 |
| 2,904,188 | 9/1959 | Richardson | 211/65 |
| 2,940,200 | 6/1960 | Endlich | 211/65 X |
| 3,153,526 | 10/1964 | Pawsey | 248/221 |
| 3,298,531 | 1/1967 | Wilcke | 211/70.6 |
| 3,537,595 | 11/1970 | Mathisen | 211/60 |
| 3,702,136 | 11/1972 | Albertson | 211/70.6 |
| 3,721,348 | 3/1973 | Cook | 211/60 |
| 3,822,019 | 7/1974 | Baatz | 211/70.6 |
| 3,837,477 | 9/1974 | Boudreau | 211/70.6 X |
| 4,064,991 | 12/1977 | Swanson | 211/70.6 X |
| 4,310,094 | 1/1982 | Hotchkiss, Jr. | 211/60 |
| 4,313,587 | 2/1982 | Loeschen | 248/217.2 |
| 4,353,465 | 10/1982 | Rado | 211/70.6 X |
| 4,583,647 | 4/1986 | Schinzing | 211/60.1 |
| 4,765,584 | 8/1988 | Lazaris | 211/70.1 X |
| 4,809,940 | 3/1989 | Trestyn | 248/220.4 |
| 4,871,074 | 10/1989 | Bryson et al. | 211/13 |
| 5,097,966 | 3/1992 | Miller | 211/70.6 X |
| 5,224,609 | 7/1993 | Bauer et al. | 211/70.6 X |
| 5,346,063 | 9/1994 | Chow | 211/70.6 X |
| 5,485,931 | 1/1996 | Barr, Jr. | 211/87.01 X |
| 5,505,316 | 4/1996 | Lee | 211/70.6 |
| 5,598,924 | 2/1997 | McCann | 211/70.6 X |
| 5,609,259 | 3/1997 | Menard | 211/66 |
| 5,638,964 | 6/1997 | Ernst | 211/70.6 |
| 5,678,700 | 10/1997 | Crosson, Jr. | 211/60.1 X |

FOREIGN PATENT DOCUMENTS

| | | | |
|---|---|---|---|
| 2619295 | 8/1987 | France | 211/65 |

*Primary Examiner*—Daniel P. Stodola
*Assistant Examiner*—Khoa Tran
*Attorney, Agent, or Firm*—Price, Heneveld, Cooper DeWitt & Litton

[57] ABSTRACT

A storage rack for compactly holding elongated items such as garden tools and the like. The rack is preferably one piece and uses the depth out away from the wall to hold multiple items. It preferably supports the items at two places to hold them securely in place. However, the recesses in one piece are shaped so that support at one place is adequate. It easily receives and releases the items individually.

15 Claims, 3 Drawing Sheets

STORAGE RACK FOR ELONGATED ITEMS

This invention relates to a storage rack for compactly holding garden tools or the like from the wall of a garage or other storage place.

BACKGROUND OF THE INVENTION

Storage racks for hanging garden tools or the like have been in existence for some time. However, to my knowledge, none of these storage racks have been capable of being manufactured cost effectively and at the same time function to efficiently store a large variety of differently configured items having long handles such as rakes, shovels, hoes, ball bats, and the like. Such racks like that disclosed in U.S. Pat. No. 3,721,348 have been constructed of a number of parts welded together making them costly both from the cost of the parts and the assembling of the same. Further, none of these type of racks have been effective in easily receiving and individually holding the items.

SUMMARY OF THE INVENTION

In accordance with my invention, I provide a storage rack which is a unique, simple rack, preferably one piece, that extends from the wall on which it is mounted and uses the depth out away from the wall to hold multiple items having an elongated part. The rack preferably includes an upper leg formed by an upper rectangular bar-shaped section extending at an angle away from the vertical surface and an inclined lower leg formed by a lower rectangular bar section connected to the upper bar and extending at an inclined angle downwardly from the upper bar section toward the vertical support surface, thus supporting the upper bar which includes a series of uniquely shaped slots spaced along its length. Each slot of the upper bar is uniquely shaped to receive an elongated part of the item to be supported. Although the upper bar with its uniquely shaped slots can be constructed to adequately support the items, the lower inclined bar section is preferred because it includes a series of second slots spaced along its length and shaped to receive an elongated part of the item to be supported. The slots in the upper bar and the slots in the lower bar are positioned with respect to each other to receive the elongated part of the item to be supported in a desired relationship. The free ends of the two bars each includes means at their ends for attaching the entire bar to a vertical support surface for mounting the rack on a vertical support surface.

In a preferred form of my invention, the upper leg is substantially horizontal but slightly inclined toward the wall on which the rack is supported. The angle of this upper leg and the shape of the slots in the upper leg is such that the slots provide an inlet opening portion at one side of the bar leading into a retainer opening portion extending from the inlet opening toward the inclined angle of the rack. Preferably, such inclination is toward the wall on which the rack is mounted. Thus, when an elongated part is inserted into the inlet opening portion the entire item slides into the retainer opening portion by virtue of the inclination of the upper bar thus more securely holding the item in the slots. The unique shape of the retainer opening portion also helps to hold items more securely.

Another preferred form of this invention is to locate the slots in the lower inclined bar at a position aligned with but offset slightly from the vertical of the slots in the upper bar. This offset of the slots helps to contain the stored items in the rack and helps hold the elongated portions of the items at a desired angle.

These and other features, advantages and objects of the present invention will be further understood and appreciated by those skilled in the art by reference to the following specification, claims and appended drawings.

DETAILED DESCRIPTION OF PREFERRED EMBODIMENT

Figure 2:
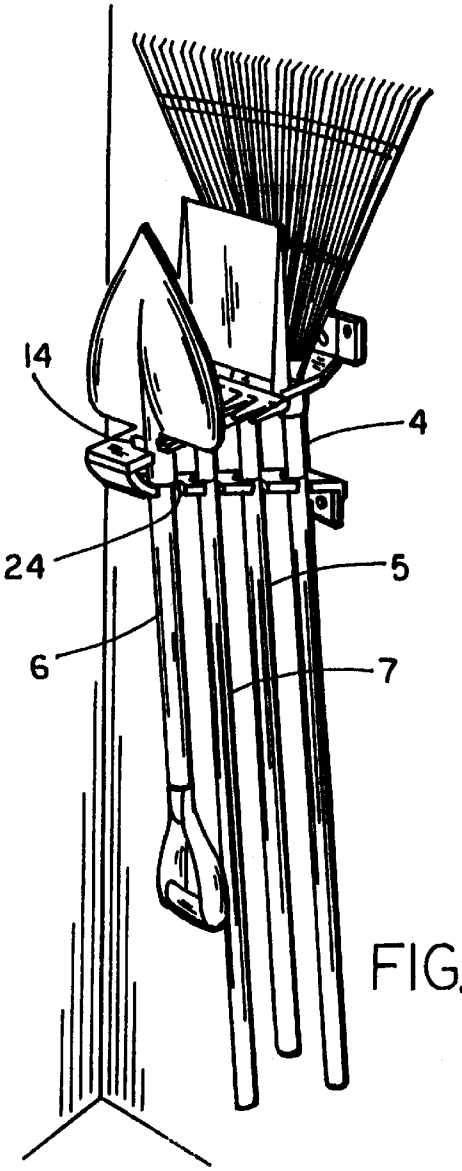
FIG. 2 is a side elevational view of the rack of FIG. 1 containing a number of different items stored on the rack.
Figure 1:
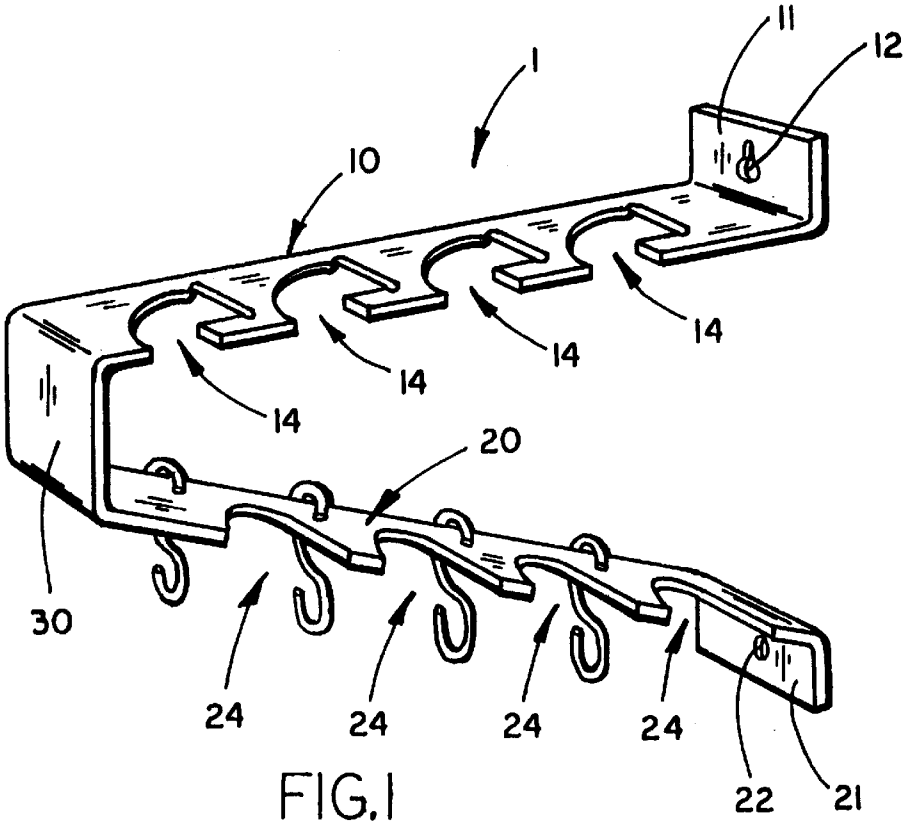
FIG. 1 is a side elevational perspective view of the invention comprising my storage rack.

Referring to the drawings, reference numeral 1 designates the overall support rack of this invention which includes an upper bar-like section 10 and a inclined lower bar-like section 20 connected together by the bight section 30.

The bar-like section 10 includes a flange 11 extending upwardly from the free end. Flange 11 is provided to secure or mount the rack on a wall or stud of a garage or other storage building. For this purpose, a central opening 12 having a key-like shape for receiving attachment member such as a screw or nail is provided.

Figure 4:
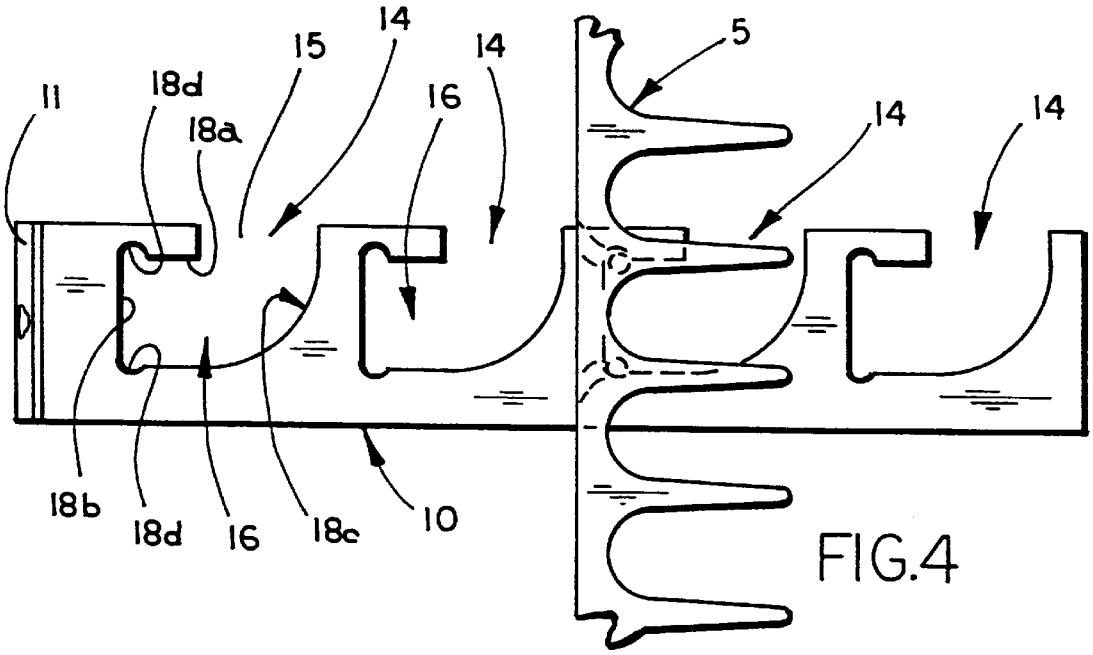
FIG. 4 is a partial plan view of the rack of FIG. 1 disclosing the unique shape of the slots in the top bar section of the rack of FIG. 1.

The bar-like section 10 includes the uniquely shaped slots, the shape of which is best disclosed in FIG. 4. Referring to FIG. 4, slots 14 each comprise an entrance opening portion 15 on one side of the bar-like section 10. Inlet opening portion 15 leads into a retainer opening portion 16. The slot 14 takes the form of the edge 18*a,* edge 18*b,* and the arcuate edge 18*c*. Between edges 18*a,* 18*b,* and 18*c* is provided the recesses or indentations 18*d* provided to receive the bowed support members of a rack such as rack 7 of FIG. 2 as illustrated in FIG. 4. The sizes of slots 14 are sufficiently large to receive an elongated member of the tool or other item such as a handle.

Figure 3:
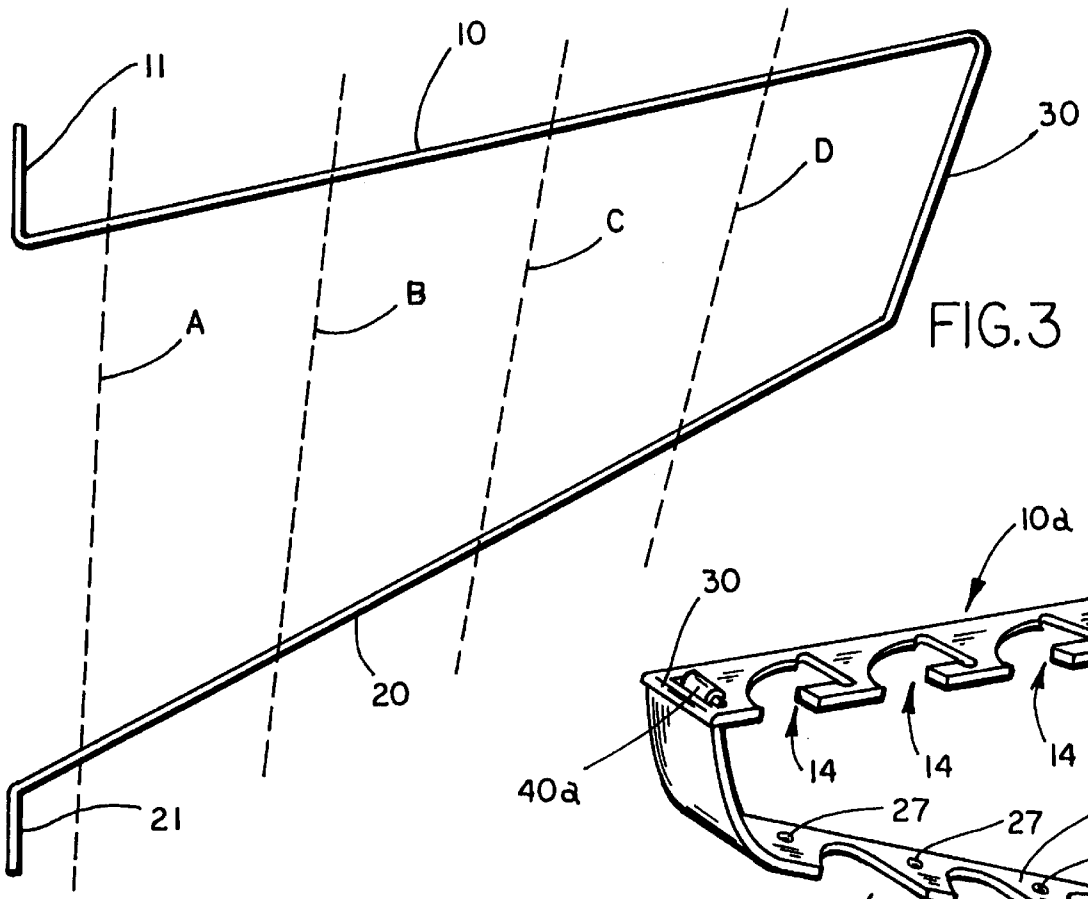
FIG. 3 is a side elevational view of the rack of FIG. 1.

It will be noted that the bar-like section 10 although substantially horizontal is inclined a slight angle of about 10 to 15 degrees (FIG. 3) so that when the elongated element of the tool or other item is inserted in the entrance opening portion 15 of a slot 14 it will slide downwardly along edge 18*c* by reason of the inclination of bar 10 toward the surface on which the rack is mounted so as to abut against the edge 18*b* of each slot.

Figure 5:
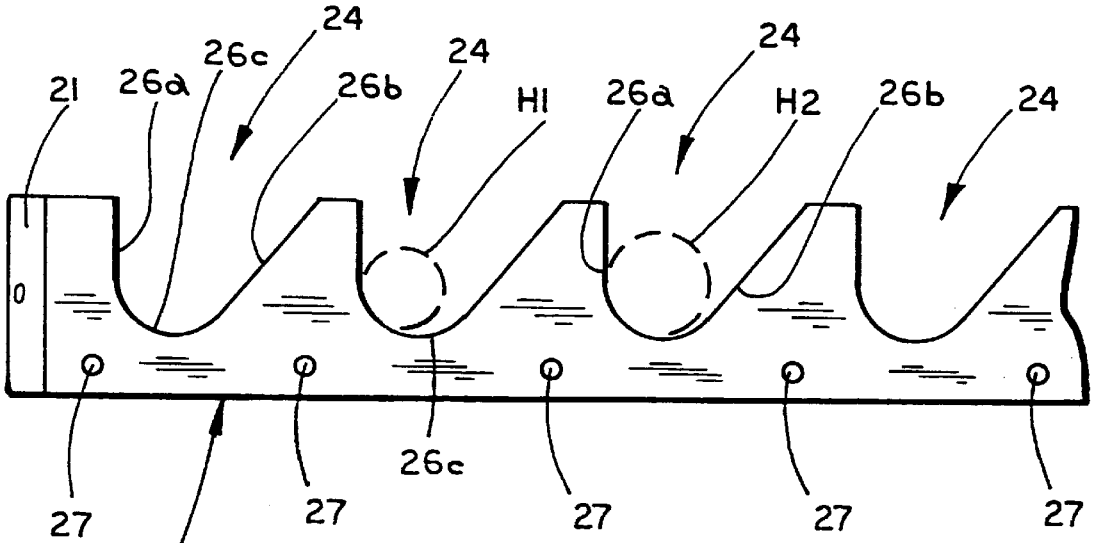
FIG. 5 is a plan view of the lower inclined bar section of the rack of FIG. 1 illustrating the preferred shape of the slots.

The lower inclined bar section 20, in FIG. 5, also includes a flange 21 at its free end (i.e., opposite the bight portion 30) for securing the bar section 20 to the surface on which the rack is to be mounted. Bar section 20 provides a support for the bar section 10 and also includes a series of slots 24. Bar section 20 also includes a plurality of openings 27 for receiving hooks on which items such as hand tools and the like can be hung.

Slots 24 are positioned vertically under slots 14 but slightly inwardly to the wall on which the rack is to be mounted. The purpose of this location is to mount the elongated handles or other items at an angle slightly inclined toward the wall on which the rack is mounted as illustrated by the phantom lines A, B, C, and D in FIG. 3. The relationship of the associated slots on the upper and lower legs is such that when in use the angle toward the vertical wall of the elongated handle is greater as its position moves away from the wall. Slots 24 include the inlet openings that are shaped to provide a straight edge 26*a* and an inclined edge 26*b* connected together by the arcuate edge section 26*c*. The inclined edge 26*b* is provided to accommodate different size handles in the slot 24. Thus, smaller diameter handles as illustrated by handle H1 will engage the crest of arcuate edge 26*c* while larger diameter handles as illustrated by handle H2 will engage edge 26*a* and edge 26*b*. The flat edge 26*a* is provided to maintain a consistent desired angle of the handles so as to hold them out of the way toward the vertical support surface on which the rack is mounted.

Figure 6:
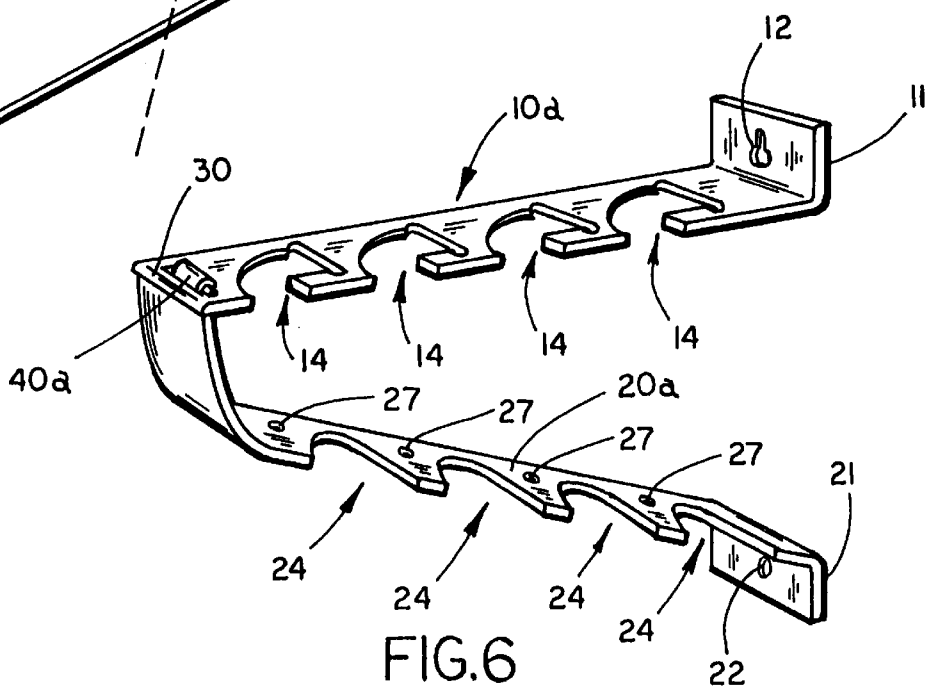
FIG. 6 is a modified rack constructed of two pieces.

Although the preferred form of the rack is constructed of one piece as disclosed in FIGS. 1–5, the rack can be constructed of two pieces as disclosed in FIG. 6 wherein the ends of the bar-like sections 10*a* and 20*a* are formed with interlocking end members 30*a* and 40*a*. In this modification, the two parts 10*a* and 20*a* can be shipped unassembled and when installed the two fingered ends 30*a* and 40*a* are meshed together and the unit as a whole is secured to the surface of a wall on which it is mounted.

The advantage of a two piece rack is the minimization of the carton size in which the rack is shipped and sold. The disadvantage is that the two parts 10*a* and 20*a* are required to be attached to each other before mounting the rack on the wall. Also, the strength of the rack can be adversely affected because of the attachment to parts 10*a* and 20*a* together.

OPERATION

The operation of the rack should be evident from the above description. FIG. 2 discloses a rack mounted on a wall 2. This is accomplished by first deciding the height the rack is to be installed. Next a screw is screwed into the wall such as a solid surface or stud of a building leaving a slight gap between the head and the wall. The bottom circular part of key hole opening 12 is then inserted over the head of the screw and the rack 1 is pulled down causing the head of the screw to be captured over the narrower upper section of the key hole 12. The rack is then adjusted to be vertical, that is, with the bar section 10 located directly above the bar section 20. Then a screw or other attachment member is inserted through opening 22 in the flange 21 of bar section 20. This mounts the rack securely to the surface of the building ready for use.

The items having elongated members such as a rake 4, shovels 5 and 6, and rack 7 are then slid into the nearly vertically aligned openings 14 and 24. Since both of the bar sections 10 and 20 are inclined downwardly toward the wall and the slots 10 and 20 are slightly misaligned vertically, the elongated elements of the tools or other items such as the handles as disclosed seek the reception portion of slots 14 as the handles slide downwardly on the edges 18*c* to rest against the straight edge 18*b* between the indentations 18*d* of the bar section 20. The handles also slide downwardly on edges 26*b* to rest against the straight edge 26*a* within the curvilinear edge 26*c* of bar section 20.

Although I have described a preferred embodiment of my invention, it should be understood that those skilled in the art may make modifications to my invention without departing from the conceptual spirit of it. Therefore, it is intended that all modifications made within the spirit of this invention are to be included within this application and equivalence thereof should be covered by this patent except as specifically provided by the appended claims.

The invention claimed is:

1. A storage rack for supporting in spaced relationship away from a vertical support surface items having at least an elongated part comprising:

an upper leg formed by an upper elongated bar; said upper bar having a first top surface, a first bottom surface, and a first body portion located between said first top surface and first bottom surface; said upper bar having a first end and a second end and a first side and a second side extending along said first top surface, said first bottom surface, and said first body portion;

said elongated upper bar having a first attachment located on said first end for attachment to a vertical surface;

said first attachment when supported on a vertical surface supporting said upper bar at an angle extending lengthwise away from a vertical surface with said first top surface facing upwardly and said first bottom surface facing downwardly;

a lower leg formed by an elongated lower bar;

said lower bar having a second top surface, a second bottom surface, and a second body portion located between said second top surface and said second bottom surface;

said lower bar having third and fourth ends, said lower bar having third and fourth sides extending along said second top surface, said second body portion and said second bottom surface;

said third end of said lower bar connected to said second end of said upper bar; a second attachment on the fourth end of said lower bar for attaching said lower bar on a vertical support surface;

said second attachment when supported on a vertical surface supporting said lower bar at an angle extending lengthwise away from a vertical surface with said second top surface facing upwardly and said second bottom surface facing downwardly;

said first and second attachments located on a plane;

said lower bar extending at an inclined angle downwardly from the second end of said upper bar to said plane for providing support to said upper bar on a vertical support surface when said upper bar is attached to a vertical surface;

a series of first slots in said first top surface, said first bottom surface, and said first body portion of said upper bar, said series of first slots extending through said first side and toward but short of said second side, said first slots spaced along the length of said upper bar between said first and second ends away from a vertical surface when said rack is supported thereon, each of said first slots shaped to receive an elongated part of an item;

a series of second slots in said second top surface, said second lower surface, and said second body portion of lower bar, said second slots extending through the third side toward but short of said fourth side of said lower bar, said second slots spaced along the length of said lower bar between said third and fourth ends and away from a vertical surface when said rack is supported thereon, said second slots being shaped to receive an elongated part of an item; and said first bar located substantially vertically above said second bar when said first attachment is secured to a vertical support substantially vertically above said second attachment whereby each one of said first slots of said series of first slots is positioned with respect to one of said second slots of said series of second slots so as to receive the same elongated part of an item.

2. The storage rack of claim 1 in which said upper and lower bars are formed of a one-piece bar.

3. The storage rack of claim 2 in which the upper bar is inclined downwardly toward said first end at an angle less than the angle of inclination of the lower bar and the first slots of said first series of slots are shaped to provide an inlet opening in one side of the upper bar leading into a retainer opening extending from said inlet opening toward said first end whereby an elongated part inserted in said inlet opening slides into said retainer opening by virtue of the inclination of said upper bar.

4. The storage rack of claim 3 in which when said first and second attachments are supported in a vertical surface with said first attachment located vertically above said second attachment each of the second slots of said second series of slots are slightly vertically misaligned in a direction toward said fourth end with a first slot of said first series of slots whereby the elongated part extending through said slightly misaligned first and second slots extend downwardly toward the plane and toward the vertical support surface to which said storage rack is mounted.

5. The storage rack of claim 3 in which the second slots of said series of second slots each include a first edge substantially perpendicular to said third side of said lower bar, said first edge being located closest to the second attachment and merging with an arcuate edge spaced from said third side, and said arcuate edge merges with an inclined edge inclined away from said arcuate edge in a direction away from said second attachment and toward said third side.

6. The storage rack of claim 3 in which indentations are provided in the retainer opening for receiving bowed support members of a bow rake.

7. The storage rack of claim 1 in which said upper and lower bars form substantially an inverted "V" with respect to said plane.

8. The storage rack of claim 7 in which each of said first and second attachments is a flange on each first and fourth ends of said upper and lower bars, respectively, said flanges extending along said plane.

9. The storage rack of claim 8 in which each of said flanges have edges and include an opening between said edges for receiving an attachment member and said edges include a slot for receiving an attachment member.

10. The storage rack of claim 1 in which said upper and lower bars are separate bars connected together at the second end of said upper bar and the third end of said lower bar.

11. The storage rack of claim 1 in which the upper bar is inclined downwardly from said second end toward said first end at an angle substantially less than the angle of inclination of the lower bar.

12. The storage rack of claim 11 in which the first slots of said first series of slots are shaped to provide an inlet opening in the first side of the upper bar leading into a retainer opening extending from said inlet opening toward said first end whereby an elongated part inserted in said inlet opening slides into said retainer opening toward said one end by virtue of the inclination of said upper bar.

13. The storage rack of claim 11 in which when said rack is mounted on a vertical surface each of the second slots of said second series of slots is slightly vertically misaligned with a first slot of said first series of slots whereby elongated parts extending through said slightly misaligned slots extend downwardly toward said plane.

14. The storage rack of claim 1 in which when said first and second attachments are supported in a vertical surface with said first attachment located vertically above said second attachment each of the second slots of said second series of slots are slightly vertically misaligned in a direction toward said fourth end with a first slot of said first series of slots whereby the elongated part extending through said slightly misaligned first and second slots extend downwardly toward the vertical support surface to which said storage tool rack is mounted.

15. The storage rack of claim 1 in which the second slots of said series of second slots each include a first edge substantially perpendicular to said third side of said lower bar, said first edge being located closest to the second attachment and merging with an arcuate edge spaced from said third side, and said arcuate edge merges with an inclined edge inclined away from said arcuate edge in a direction away from said second attachment and toward said third side.

* * * * *